US006095098A

United States Patent [19]

Beal et al.

[11] Patent Number: 6,095,098

[45] Date of Patent: Aug. 1, 2000

[54] COMPUTER CONTROLLED INJECTION DEVICE FOR GENERATING STEAM

[76] Inventors: Lou A. Beal, P.O. Box 959, Coleman, Tex. 76834; David E. Orr, 1629 Ruth St., Arlington, Tex. 76010

[21] Appl. No.: 09/143,034

[22] Filed: Aug. 28, 1998

Related U.S. Application Data

[60] Provisional application No. 60/057,729, Aug. 28, 1997.

[51] Int. Cl.[7] ..... F22B 37/42

[52] U.S. Cl. ..... 122/448.1; 122/444; 122/446; 122/451.1

[58] Field of Search ..... 122/448.1, 448.2, 122/448.3, 448.4, 451.1, 444, 446, 447

*Primary Examiner*—Teresa Walberg
*Assistant Examiner*—Jiping Lu

[57] ABSTRACT

A steam generation device comprising two cylinders, an inner and an outer cylinder, the inner cylinder forming a combustion chamber into which streams of air, water and fuel are released under computer control. Water is introduced under pressure into the plenum formed by the inner and outer cylinder and exits into the combustion chamber top holes drilled at an angle into the inner cylinder. Using a model of the combustion process and the flame's gas envelope pressure, the computer maintains combustion and steam production without extinguishing the flame, in response to demands for differing quantities of steam volume, temperature and pressure.

1 Claim, 9 Drawing Sheets

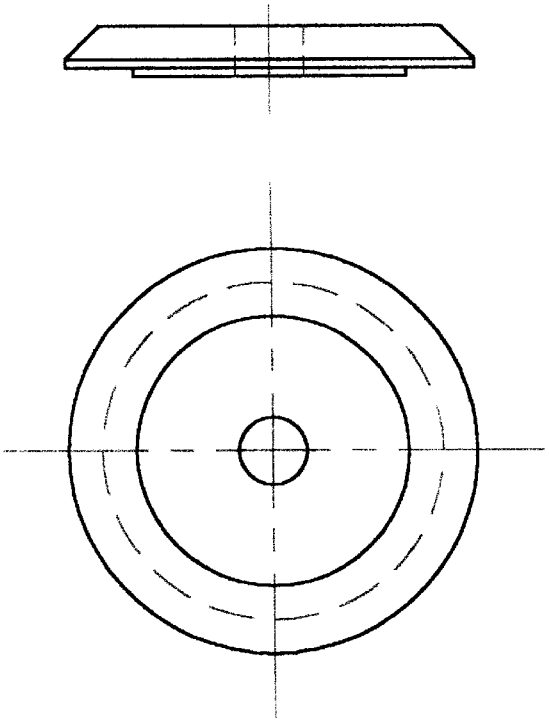
FIG 1T
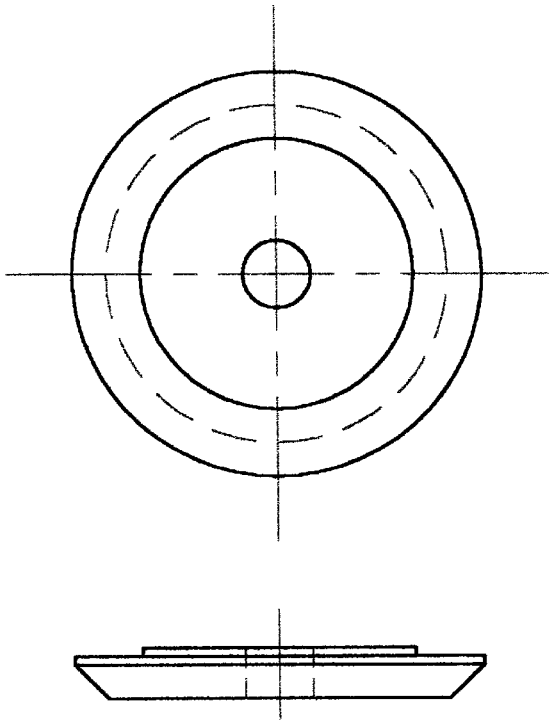
FIG 1B
FIG. 1

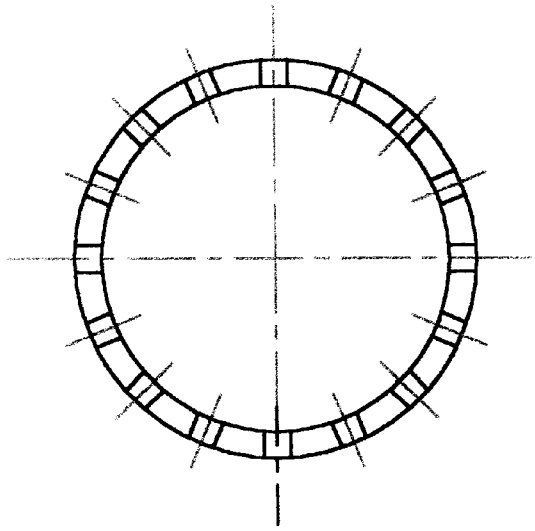
FIG 3A
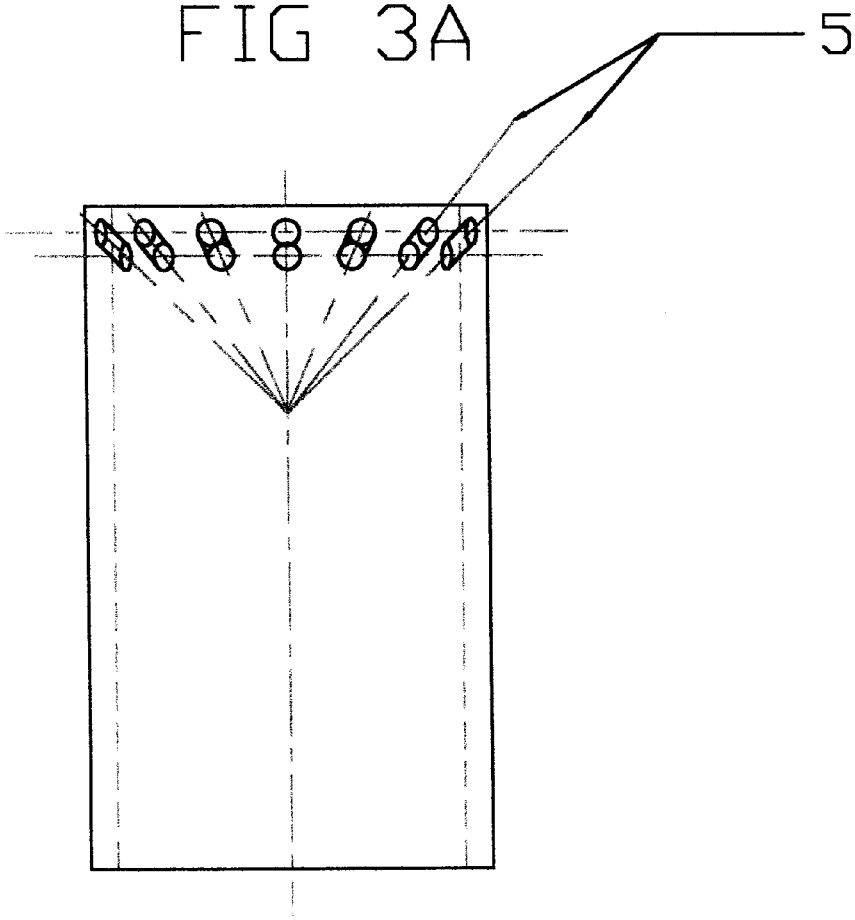
FIG 3B
FIG 3

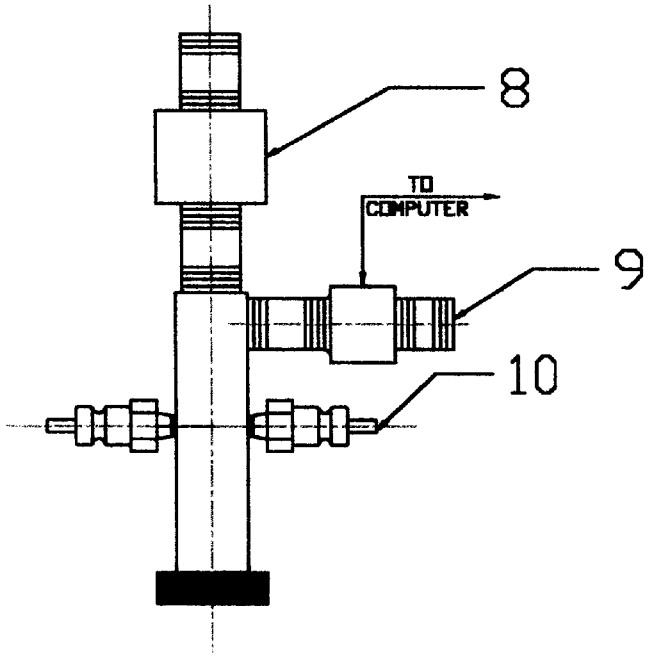
TEXT 8A
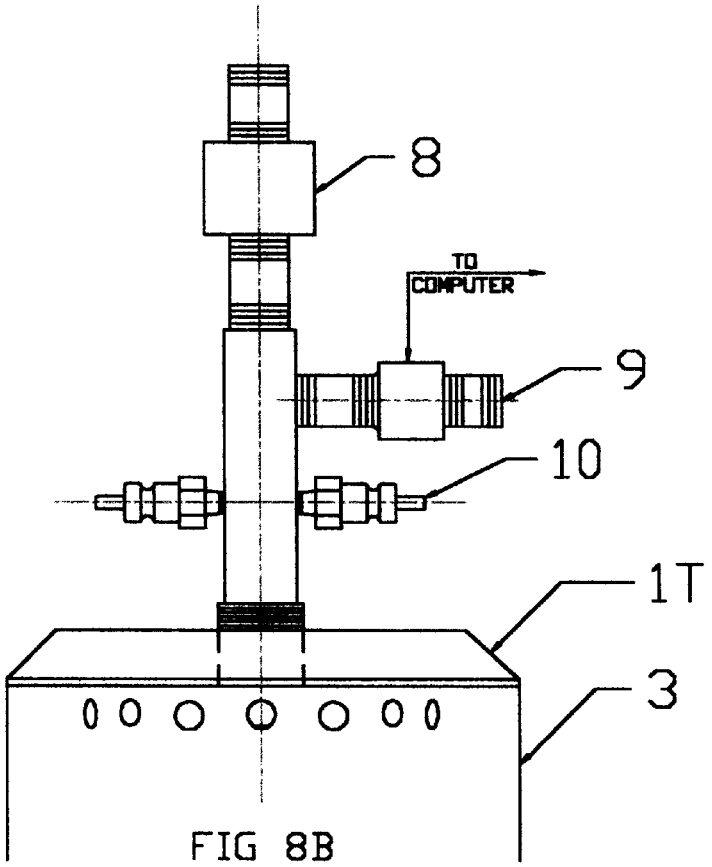
FIG 8B
FIG 8

COMPUTER CONTROLLED INJECTION DEVICE FOR GENERATING STEAM

CROSS-REFERENCE TO RELATED APPLICATIONS

This application is related to and derives priority from the application entitled *Novel steam and nitrogen injection device and chemical process for heavy oil recovery;* application number 60/057,729, filed Aug. 28, 1997.

TECHNICAL FIELD

The invention relates to devices for generating steam, and more specifically to devices which employ direct injection of water into a combustion chamber.

BACKGROUND ART

Various devices have been invented for the purpose of generating steam directly, by injecting water into a plenum which forms the combustion chamber for an air and fuel mixture. These devices have been designed to produce steam without heating a containing device filled with water, and thereby obviate the problem of heat energy loss from unintended transfer to the containing device, and thence to the surroundings.

In general, these devices all operate by first providing a combustion chamber into which hydrocarbon fuel and air are mixed, thence igniting the fuel and air mixture with a sparking mechanism. Simultaneously, a stream of water is directed into the chamber and into the flame. Energy from the flame is transferred to the water, producing steam. Steam is transferred, along with the products of combustion, out of the chamber and into a pipe or some other conveyance means to a place or to a device which uses the steam.

These devices are arranged so that the water is introduced onto the periphery of the incandescent envelope formed by fuel- air combustion. By doing so heat energy is transferred to the water and is quickly removed from the chamber with combustion effluents, and, in the process, combustion chamber walls are kept relatively cool.

It will be appreciated that one of the problems with such an arrangement is that without precise control of water flow, the injected water can easily collapse the incandescent envelope and extinguish the flame. Therefore, in addition to maintaining control over the stochiometric requirements for efficient combustion, operation of the device requires dynamically maintaining a fine balance between the pressure of the incandescent envelope and the pressure of injected water as the flow rate and volume of injectants change. Furthermore when these devices must operate over a wide range of requirements and must respond quickly to changing demand for steam volumes and temperatures, maintaining this balance becomes even more critical.

SUMMARY OF THE INVENTION

Accordingly, it is a primary object of the present invention to provide a steam generation device in which the injection of water can be controlled to prevent extinguishing the flame defined by the incandescent envelope Another object of the present invention is to provide a steam generating device in which water injection can be adaptively controlled to meet varying requirements for steam volumes and temperatures, as demanded by a human operator.

And yet another object of the present invention to provide a mechanism for controlling steam generation so that maximum energy is imparted from the incandescent envelope to injected water.

And a final object of the invention is to provide a mechanism for the steam generating device to find and store valve settings required to achieve optimal operating conditions.

Additional objects, advantages, and other novel features of the invention will be set forth in part in the description that follows and in part will be apparent to those skilled in the art upon examination of the following or may be learned with practice of the invention.

To achieve the foregoing and other objectives, and in accordance with the purpose of the invention, a computer controlled steam generating device in which water is injected into a combustion chamber and onto an incandescent envelope of combusting fuel, and in which water is introduced and controlled so that the incandescent envelope is maintained and imparts maximum heat energy to the water.

Fuel, air and water sources- pressures and volumes- are controlled by a computer controller with program which is provided as part of the invention. Pressures and volumes of fuel, water and air entering the invention are controlled through calculations performed by the program in response to requirements for steam volumes and temperatures specified by a human operator. Adjustments to fuel, water and air flow volumes and pressures are made by the invention through computer controlled inlet valves that are part of the present invention. A feedback loop is provided from the point where steam exits the present invention, wherein feedback data consists of steam temperature measured by a sensor, which, in turn, is sampled by the computer controller. The computer controller program uses the feedback temperature values to maintain optimal injected water pressure. Once found the computer controller saves valve settings that are associated with the optimal conditions for operating in response to specified demands. When the same operating conditions are specified, later, the computer controller retrieves those settings and uses them.

BRIEF DESCRIPTION OF THE DRAWINGS

The accompanying drawings, incorporated in and forming a part of the specification, illustrate several aspects of the present invention, and together with the description serve to explain the principles of the present invention. In the drawings:

DETAILED DESCRIPTION OF THE INVENTION PREFERRED EMBODIMENT

In the following description of the preferred embodiment, dimensions of various components are given. Also, values for pressures for volumes and pressures of fuel, air and water are given. These dimensions are taken from an actual working device built by the inventors. Obvious variations in component dimensions are possible, such variations resulting in an embodiment of the present invention having a different size. Changes in volumes and pressures of fuel, water and air will be commensurate with changes in dimensions of components.

Refer to FIG. 1. The steam generating device claimed in the present invention is comprised of, first, a top round plate 1T and a round bottom plate 1B of the same diameter, shape and both constructed of the same material. Both plates have a diameter at their centers of not less than 0.75 inches and a thickness that varies. Refer to FIG. 1*b*. The bottom of each plate is flat, whereas the top of each plate is of uniform thickness along the radius of each plate, until a point of one inch from the periphery of each plate. At this point one inch from the periphery, the thickness of each plate tapers uniformly to a thickness of on-half inch.

The bottom side of the top plate has a circular groove, ⅝ inches wide and cut to a depth of ¼ inches. This circular groove has a diameter of 8⅝ inches and is concentric with the center of the top plate. The top plate has a threaded hole with a diameter of 2 inches cut through the plate, and that is concentric with the center of the top plate. The bottom plate has a threaded hole with a diameter of 2 inches cut through the plate, and that is concentric with the center of the bottom plate.

Material that is used for constructing the top and bottom plate depends upon the operating conditions of the apparatus, specifically, the temperatures and pressures that will be generated internally within the apparatus; however the plates can be constructed from material selected from stainless steel, or ceramic coated steel.

Figures 2, 2A:
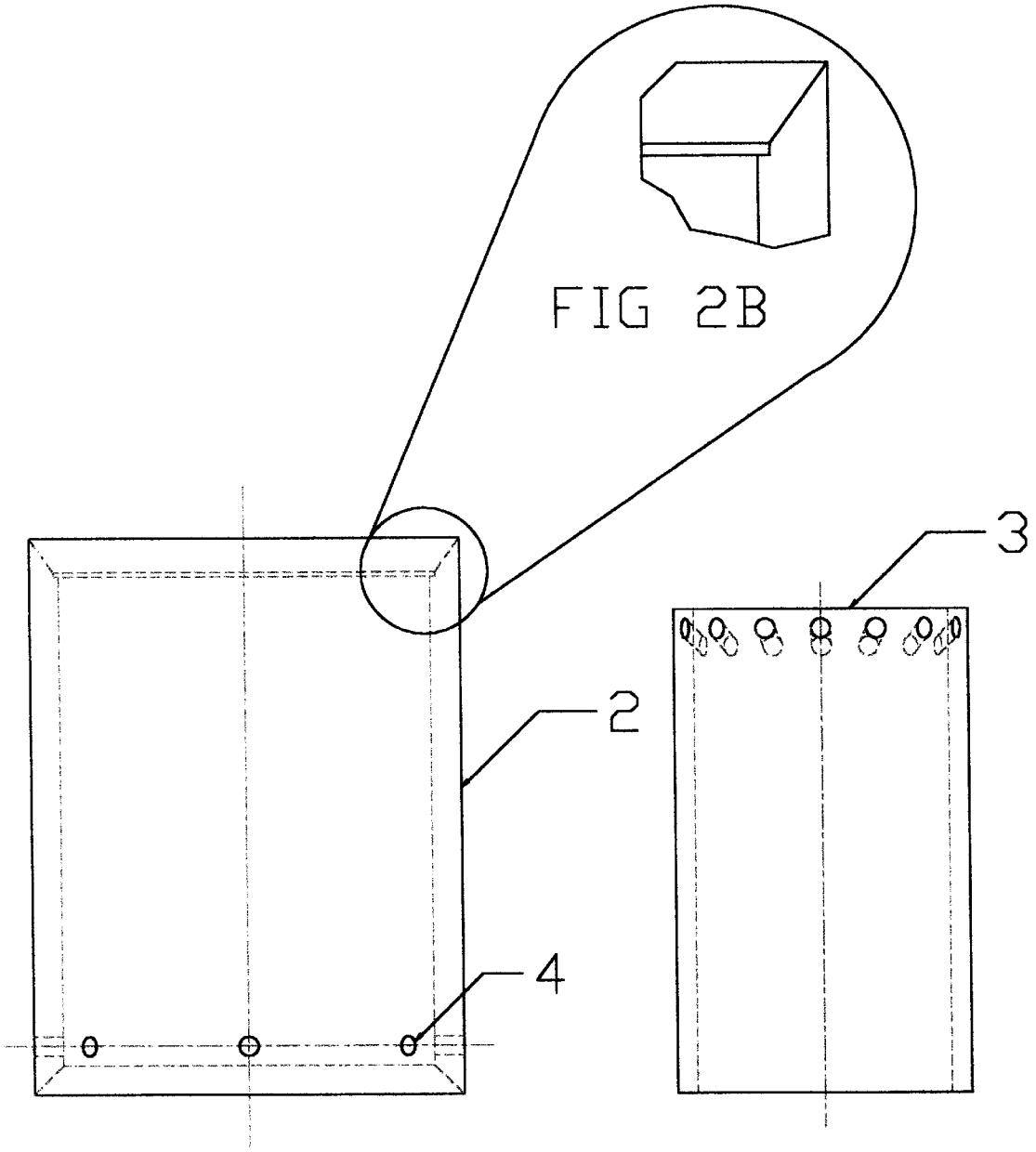

Refer to FIG. 2*a*. The apparatus also has two cylinders- 2 an outer cylinder and 3 an inner cylinder. Both cylinders are constructed of the same material as the top and bottom plates. The outer cylinder has an outer diameter of 12⅞ inches and an inner diameter of 12 inches. The bottom of the outer cylinder is distinguished from the top by a plurality of threaded holes 4 that arc drilled in the bottom part. Each of these holes is 1 inch in diameter and are drilled completely through the outer cylinder; the center of each hole is co-linear with the radius of the outer cylinder.

Refer to FIG. 2*b*. From both the bottom and top ends of the outer cylinder and to a distance of 18 inches, each end of the outer cylinder has an inner diameter of 12 inches. This construction is made to permit the top of the outer cylinder to receive and hold the top plate so that the top surface of the top plate does not extend above the top surface of the outer cylinder. Similarly, the construction of the bottom part of the outer cylinder is made so as to receive and hold the bottom plate, so that the top surface of the bottom plate does not extend below the bottom surface of the outer cylinder.

Refer to FIG. 3*a*. The top of the inner cylinder 3 is distinguished from the bottom in that the top part of the inner cylinder has a plurality of evenly spaced holes 5 with centers that are all drilled along a circle whose circumference is 1¼ inches from one end of the inner cylinder. Refer to FIG. 3*b*. Each hole has a diameter of ¾ inch and is drilled at an angle not less than 45 degrees nor more than 75 degrees slanting from the radius of the inner cylinder toward the opposite end of the inner cylinder. The purpose of the slanting holes is to provide a mechanism for directing water onto the incandescent gas envelope in such a manner that a balance can be maintained between water pressure and the outward pressure produced by the expanding gas envelope.

During operation of the present invention, water, under pressure, will be directed into the plenum formed by the outside surface of the inner cylinder, the inside surface of the outer cylinder, the bottom surface of the top plate and bottom surface of the bottom plate. As the plenum fills, water will be forced through the angled holes 5 and into the inside of the inner cylinderm and onto the incandescent envelope produced therein.

Figures 4, 4B:
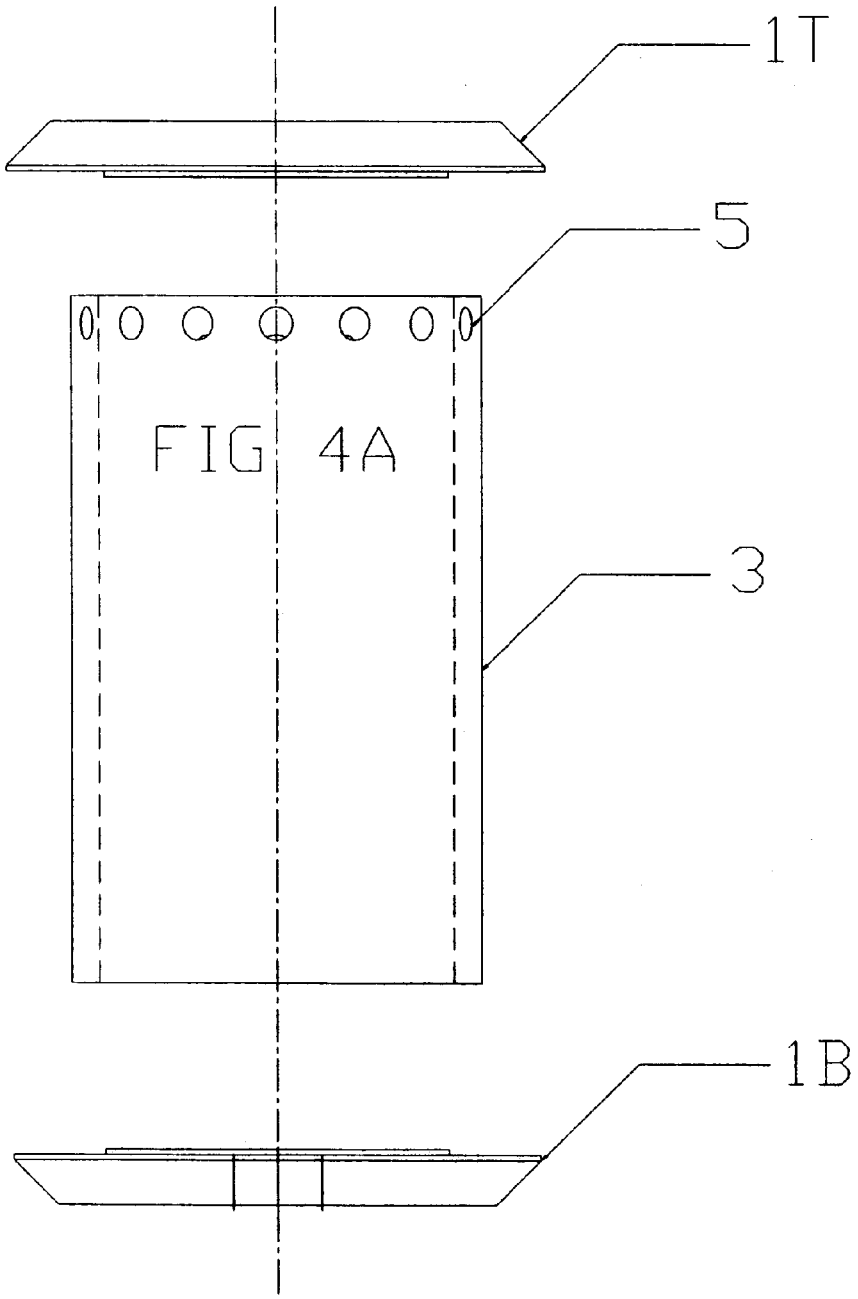

Refer to FIG. 4*a*. The inner cylinder has an outer diameter of 8⅝ inches and an inner diameter of 8 inches, permitting it to be received by the top plate and to be held firmly within the groove cut in the bottom of the top plate. Refer to FIG. 4*b*. The bottom plate also receives and holds firmly the inner cylinder; receiving the inner cylinder within the groove cut into the bottom surface of the bottom plate.

Figure 5:
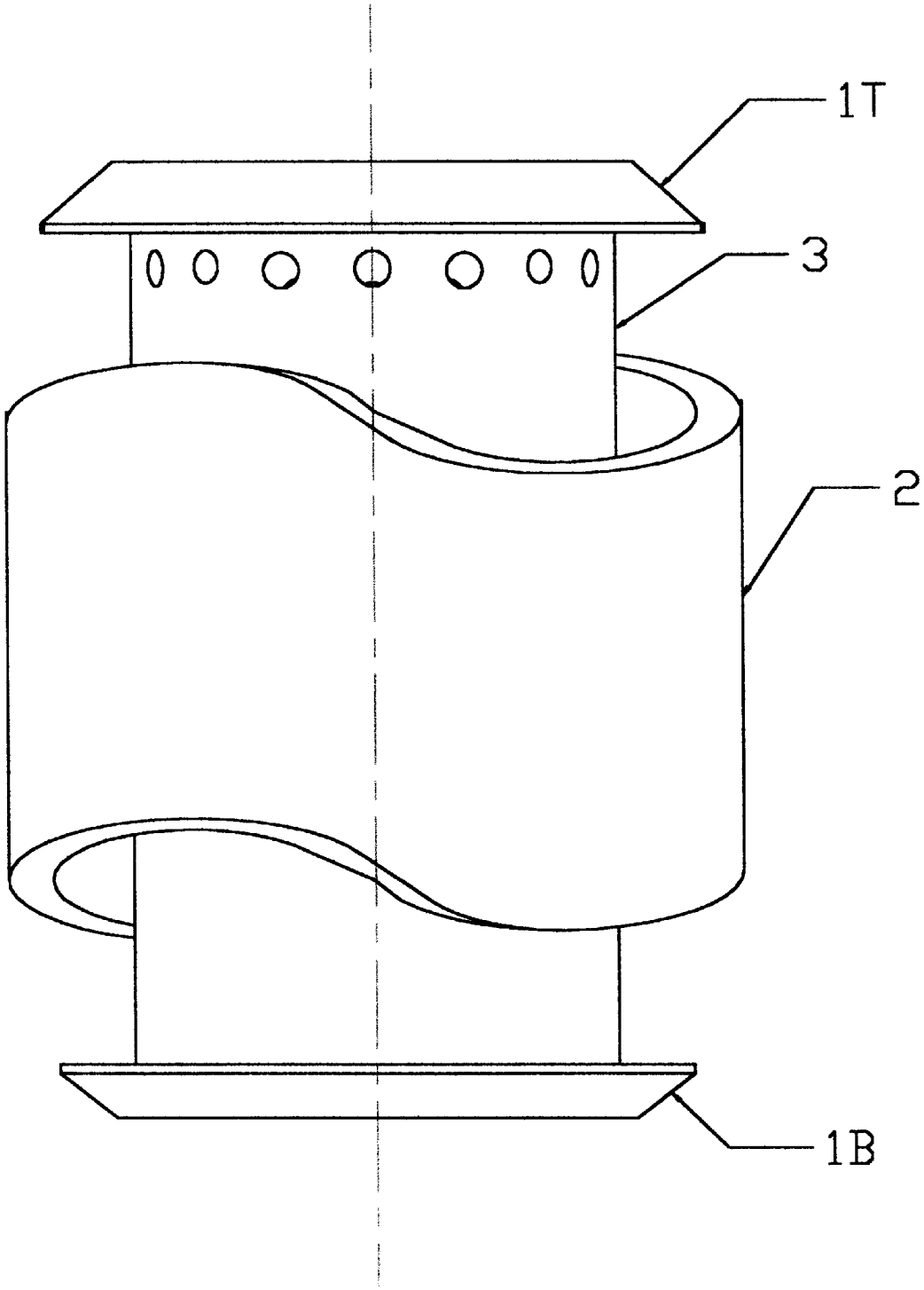
Figure 6:
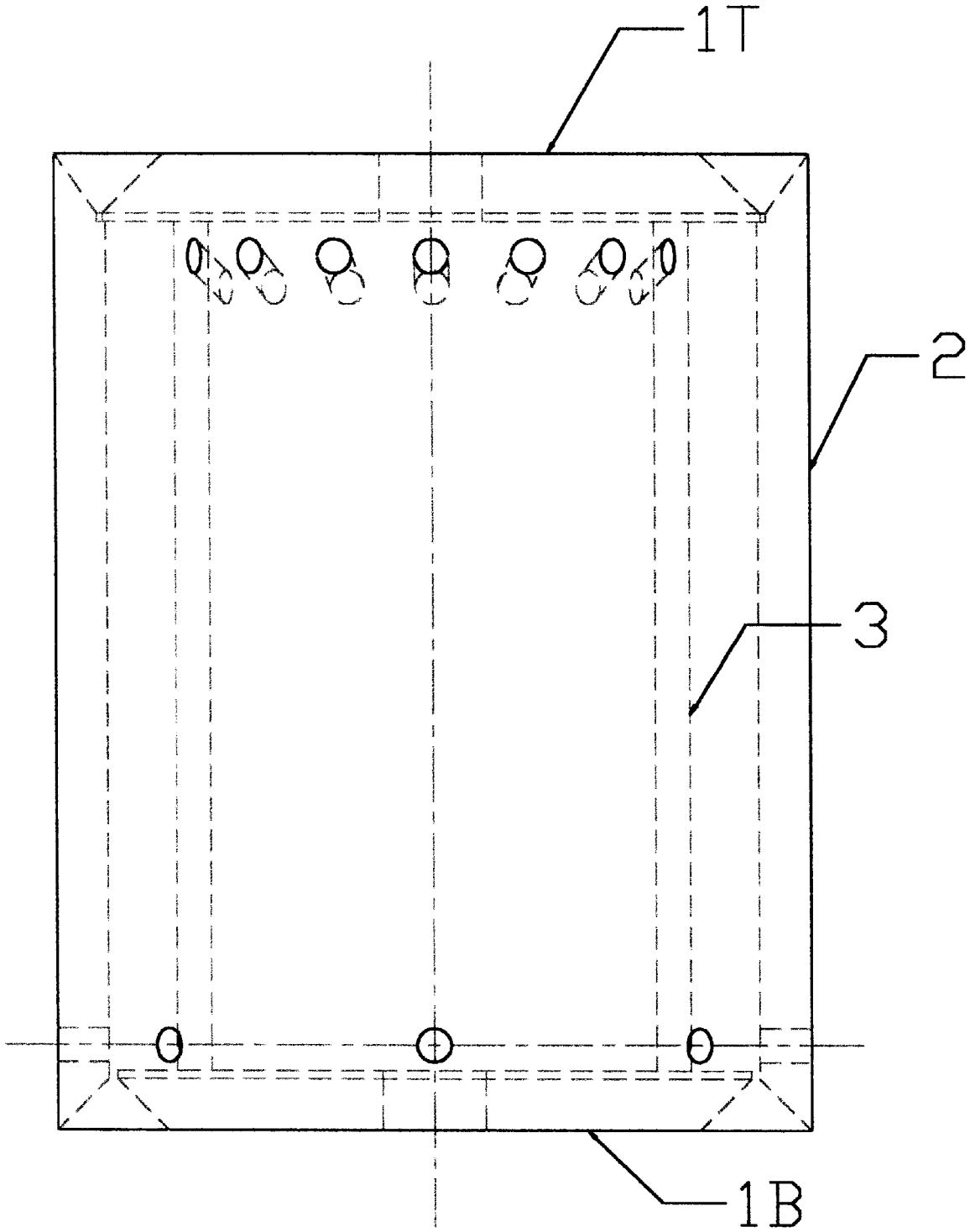

Refer to FIG. 5*a*. The length of the inner cylinder is 18 inches, permitting the top end and the bottom end of the inner cylinder to be inserted, respectively into, the groove of the top and to be received by the threaded hole in the bottom plate. The length of the inner cylinder and the position it is held by both top and bottom plates permit the top and bottom plates to be received by the outer cylinder, with the inner cylinder inside the outer cylinder. Refer to FIG. 6. When the parts of the apparatus are positioned as described, the top surface of the bottom plate is flush with the bottom of the outer cylinder and the top surface of the top plate is flush with the top of the outer cylinder, and the inner cylinder is held firm by the top and bottom plates.

Refer to FIG. 6. In this position, the top plate and the bottom plate are welded to the inner surface of the outer cylinder, the weld made so that the taper of the top surfaces of both the top and bottom plates are completely filled with welds, making the thickness of both plates uniform.

When so welded, a plenum is formed, which is bounded by the inner and outer cylinders and the top and bottom plates. When the apparatus is used, water is injected into the chamber by way of the holes 4 that are drilled into the outer cylinder. Proper construction of the apparatus will result in water flowing, under pressure, up the cylinder, through the holes 5, and into the inside of the inner cylinder, where the water is converted to steam, thence the steam flows down the inside of the inner cylinder and out the inner cylinder to outside the apparatus.

Figure 7:
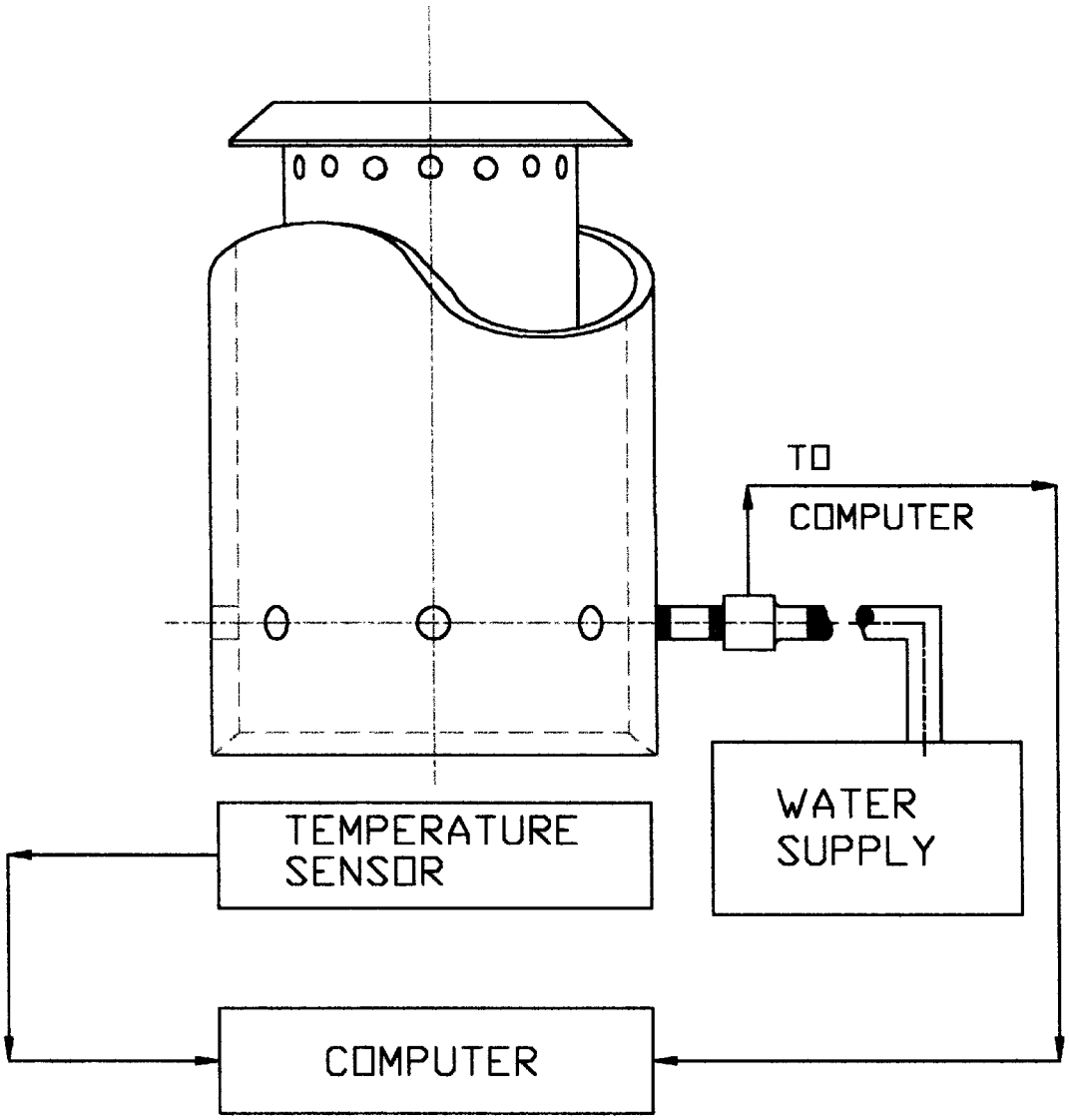

Refer to FIG. 7. Each of the threaded holes 5 receive a bottom inlet valve assembly 7 which contains a computer controlled valve capable of controlling both volume and pressure of water that: enters the chamber formed by the inner and outer cylinders. The valve assembly is a commercially available assembly that is equipped to operate under the control of a computer controller.

Refer to FIG. 8*a*. The apparatus has a top inlet valve assembly 8, through which a hydrocarbon fuel and air are injected, under pressure. The top valve assembly is constructed from two tubes which are joined so that material introduced into the tubes will flow and mix together. One tube comprises an air inlet; the second tube comprises a fuel inlet. The air inlet 8 is located 2 inches above the fuel inlet 9 1¼ inches below the fuel inlet, two threaded holes are drilled, for the purpose of receiving 2 standard automotive type spark plugs 10. The spark plugs are, in turn, connected to a mechanism of known type for creating electrical energy to fire the spark plugs. When air and hydrocarbon fuel are injected, they mix and are ignited by the two spark plugs in the top inlet valve assembly.

The air inlet and the fuel inlet are furnished with a computer controlled valve, the purpose of which is to independently control the pressure and volume of flow of the air and fuel streams, respectively. Both valves are commercially available, and are compatible with the inlets they control.

The air inlet has a inner diameter of 1½ inches and an outer diameter of 2 inches. The fuel inlet has an inner diameter of ½ inch and an outer diameter of 1 inche.

Refer to FIG. 8*b*. The bottom of the top inlet valve assembly is threaded so that the top inlet valve assembly may be screwed into the threaded hole within the top plate 1T, which has been welded into the top end of the outer cylinder.

Refer to FIG. 9*a*. The computer controlled valves in the bottom inlet valve assembly, and the computer controlled valves in the top inlet valve assembly are connected to a stored program computer controller through input and output ports, one for each valve assembly. Each input and output port is connected to an operated by an I/O card which receives signals from its respective valve assembly, and generates control signals for each respective valve assembly. Signals received by each card comprise data about the aperture of each valve. Signals transmitted to each card comprise commands to valve actuators to cause valve aperture changes.

The computer controller is also connected to, and controls water, fuel and air sources supplying the steam generating apparatus, and is connected to an appropriate temperature sensing device that measures the temperature of steam ejected from 2 inches. It will be appreciated that the appropriateness of the temperature sensing device will be determined from the range of temperatures of steam produced by the present invention. For temperatures of a few hundreds of degrees, sensors can be used that are capable of being inserted in the ejected stream. For temperatures of thousands of degrees, sensing devices that measure infrared radiation must be used.

The present invention uses equipment that is well known for the purpose of sensing and controlling both volume and pressure of fuel, water and air sources. For the preferred embodiment the water source must supply water at a rate of no less than 40 gallons per minute and at a pressure of no less than 10 pounds per square inch. Also for the preferred embodiment, the fuel source must supply a hydrocarbon selected from the group consisting of propane, natural gas or methane, and at a rate of no less than 0.854 cubic feet per second at a pressure of no less than 70 pounds per square inch. In addition, for the preferred embodiment, the air source must deliver no less than 16 cubic feet of air per second at a pressure of no less than 70 pounds per square inch.

The computer controller is provided with a console from which a human operator can direct the operation of the invention. This console is provided with a keypad with which the operator can specify desired volumes and temperature of steam that is to be supplied by the invention. The console and keypad used in the invention are commercially available devices that are well known in the art of computer hardware systems.

The computer controller is provided with a software program that is capable of computing stochiometric requirements for fuel, air and steam, when a certain volume of steam, with a certain temperature is demanded.

Figure 9:
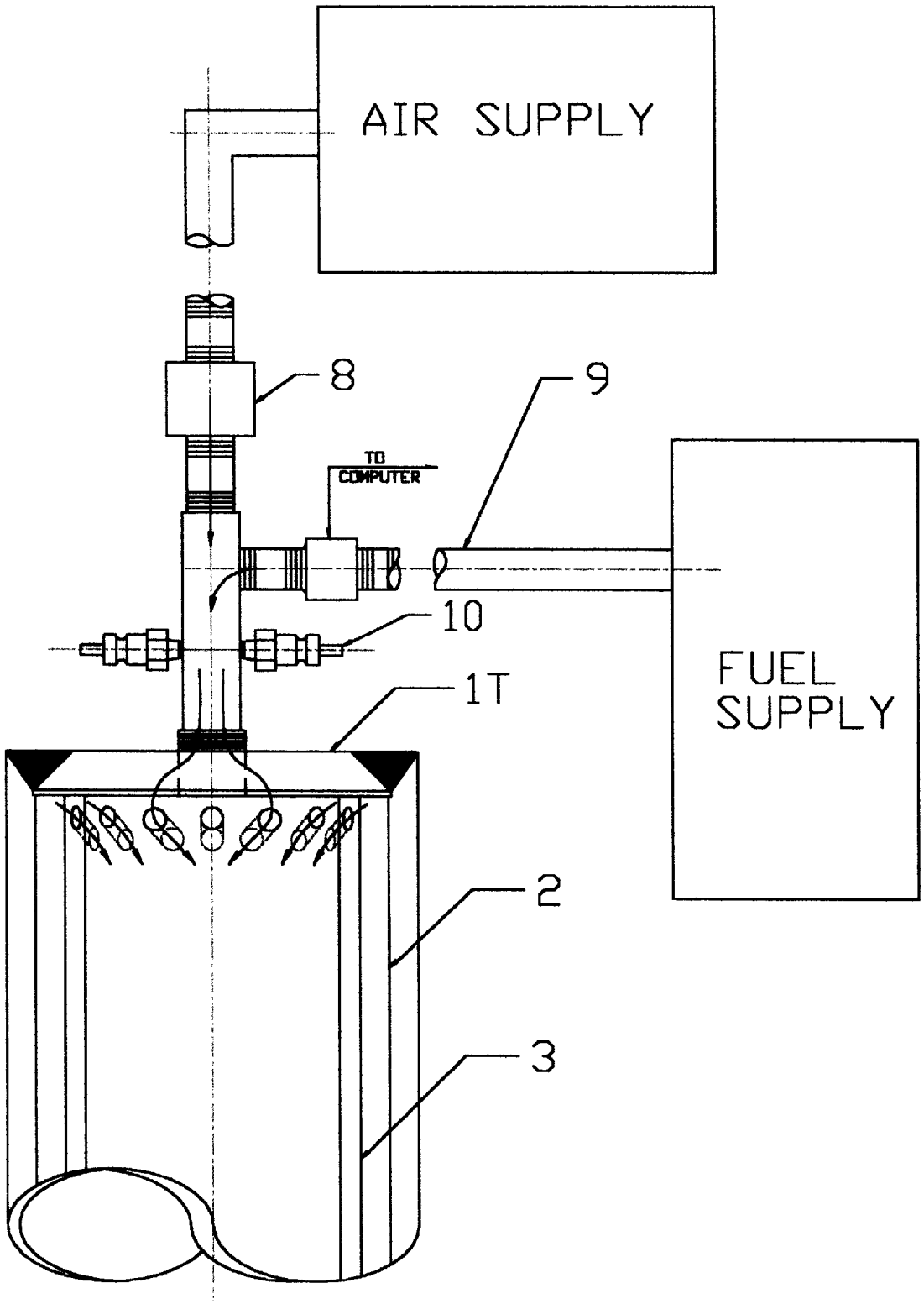

When a certain volume and temperature of steam is required, a stored program in the controller, uses a table for computing the quantity and pressures of reactants- fuel, air and water- required for producing steam at different volumes and temperatures. From primary entries in this table, the stored program can interpolate values that are needed, but are not contained with the table. Within this table are stochiometric data contain oxygen requirements for complete combustion for a plurality of hydrocarbon fuel sources. Also within this table are the energy values resulting from combustion of various hydrocarbon fuels, and values required to compute BTUs derived from combustion. The stochiometric tables are encoded as programmable read-only memories, PROMs, which are provided as part of the computer controller. From the stochiometric tables and the volume and temperature of steam specified, the computer controller program calculates the volumes and pressures required, and in turn, calculates valve settings on the inlet valves permitting entry of required volumes and pressures of air, fuel and water. valve settings, the controller program must also take into account the possibility of extinguishing of the flame created within the inner cylinder. Therefore it is critical that the valve settings must be adjusted so that the pressure of the water envelope not be sufficiently high to collapse the pressure of the incandescent envelope created by the combustion of the fuel and air mixture. This is accomplished by the controller program, in the following steps, which are essential to the present invention:

1. From the input keypad, read values for steam temperature and volume that are demanded by a human operator.
2. Compute BTU requirements for operator specified steam generation. Calculate moles of fuel and air necessary for the BTU demanded.
3. Compute an approximation to gas envelope pressure from the relation specified by the ideal gas law, $P_E=nRT/V$, in which V, volume, is calculated as 0.3 of the volume of the inner cylinder; R is the universal gas constant, and n is the number of moles of oxygen and fuel required to achieve the operator specified BTU demanded; and T is the temperature resulting from the combustion of the fuel, air mixture.
4. Compute an initial pressure, $P_w$, of water entering the inlets 5, by first computing the inward pressure, $P_{in}$, of water impinging on the incandescent gas envelope, as $P_{in}=P_w\cos\theta$ where $\theta$ is the angle between the center of each inlet and the radius of the inner cylinder. Refer to FIG. 9. Then adjust the water inlet valves to achieve the setting so that $P_{in}=0.7P_E$. With these initial settings the gas envelope and pressure will be different from than the pressure of the inward water pressure. The computer controller will change the pressure of water entering the outer cylinder to reduce the difference. Water pressure changes are made by the computer controller in increments of 1/10 of the value required to reduce the difference between the inward water pressure and the incandescent envelope pressure. This change is made and subject to feedback data obtained from the steam outlet temperature sensor.
5. Read the steam temperature value as measured by the steam outlet temperature sensor. From the previously read sensor value, which is initially set to zero and updated from each subsequent reading, calculate the difference in subsequent temperature readings. If the temperature has increased, then increment the pressure of injected water. If the temperature has decreased, then decrement the pressure of injected water. Maintain this feedback loop as long as new values for steam volumes and temperatures have not been entered by a human operator. If new values have been entered, then begin again at step 1, above.
6. Once an optimal point has been found, settings of valves are stored for later use if the associated requirements are demanded by a human operator.

It will be appreciated that by performing these adjustments using negative feedback that the invention will achieve the desired operating conditions across a wide range of requirements. And the invention will prevent injected water from extinguishing combusting fuel.

The foregoing description of a preferred embodiment of the invention has been presented for purposes of illustration and description. It is not intended to be exhaustive or to limit the invention to the precise form disclosed. Obvious modifications or variation are possible in the light of the above teachings. Modification to the size and dimensional relations of parts of the invention can obviously be made in response to differing operating requirements. All such modifications and variations are within the scope of the invention as determined by the following claims when interpreted in accordance with the breadth to which they are fairly, legally and equitably entitled.

We claim:

1. A computer controlled steam generating device comprising:

an outer cylinder, having a top and a bottom, the bottom of said outer cylinder distinguished from the top of said outer cylinder by having a plurality of threaded holes drilled uniformly through and around the circumference of said outer cylinder;

an inner cylinder, having a top and a bottom, the top of said inner cylinder having a plurality of holes drilled through and around the circumference of said inner cylinder, said plurality of holes drilled at an angle in the range of from 45 degrees to 70 degrees, as measured from the radius of said inner cylinder, and wherein said inner cylinder is received into said outer cylinder;

a top plate, having a top side and a bottom side, said top side tapering uniformly from a point equidistant from the center of said top side to the periphery of said top side, said top plate having a threaded hole concentric to the center of said top plate, and also having a groove on the bottom side of said top plate, said groove concentric with the center of said top plate, and wherein said groove receives the top of said inner cylinder, and said top plate is welded along the periphery to the inside of the top of said outer cylinder;

a bottom plate, having a top side and a bottom side, said top side tapering uniformly from the center of said top side to the periphery of said top side, and having a threaded hole concentric to the center of said bottom plate, and also having a groove on the bottom side of said bottom plate, said groove concentric with the center of said bottom plate, and wherein said groove receives the bottom of said inner cylinder, and said bottom plate is welded along the periphery to the inside of the bottom of said outer cylinder, and wherein a plenum is formed, bounded by the bottom of said top plate, the top of said bottom plate, the inside of said outer cylinder, and the outside of said inner cylinder;

a top inlet valve assembly connected to said threaded hole within said top plate and having an air inlet, said air inlet provided with a computer controlled air valve, said computer controlled air valve capable of a plurality of valve settings, said computer controlled air valve controlling air pressure and volume, top inlet valve assembly further having a fuel inlet, said fuel inlet provided with a computer controlled fuel valve, said computer controlled fuel valve capable of a plurality of valve settings, said computer controlled fuel valve controlling fuel volume and pressure, said computer controlled fuel valve and said computer controlled air valve receiving and using externally provided data values to achieve said valve settings for fuel volume and pressure and said valve settings for air volume and pressure;

a plurality of lower water inlet valve assemblies connected to said plurality of threaded holes in said outer cylinder, each said water inlet valve assembly having a water inlet, each water inlet provided with a computer controlled water valve, each said computer controlled water valve having a plurality of valve settings, each said computer controlled water valve receiving and using externally provided data values to achieve said valve settings;

spark plugs which are received into said top inlet valve assembly, said spark plugs receiving electrical voltage and current of sufficient energy and frequency to achieve ignition of fuel and air injection into said top inlet valve assembly;

a containing device for receiving and holding fuel, said fuel containing device holding said fuel under pressure, said fuel containing device connected by a fuel line to said fuel inlet of said top inlet valve assembly;

a containing device for receiving and holding water, said water containing device holding said water under pressure, said water containing device connected by a plurality of water lines, each line connected to one bottom inlet water valve assembly;

a containing device for receiving and holding air, said air containing device holding said air under pressure, said air containing device connected by an air line to said air inlet of said top inlet valve assembly; and a computer controller provided with data storing devices, said computer controller having means for communicating with and controlling said fuel valve by supplying said externally provided data values for said fuel valve settings, said computer controller having means for communicating with and controlling said air valve by supplying said externally provided data values for said air valve settings in said air valve in said top inlet valve assembly and said computer controller having means for communicating with and controlling said water valves in each of said bottom water inlet valve assemblies by supplying said externally provided data values for said water valve settings, said computer controller communicating with said steam outlet temperature sensor and receiving steam values from a steam outlet temperature sensor, said computer controller programmed to compute BTU values resulting from fuel and air combustion, said computer controller also computing stochiometric requirements for steam at specified volumes and pressures, as demanded by a human operator, said computer controller controlling said fuel valve, said air valve and said water valve to achieve specified steam volumes and pressures, and said computer controller also programmed to calculate the combustion envelope pressure and to adjust injected water pressure so that said combustion envelope is maintained and said combustion is not extinguished, said computer controller storing said supplied data values for said fuel, air and water valve settings;

whereby said computer controlled steam generation device will be capable of combusting fuel and air introduced there into, and will convert water introduced therein to steam, said computer controlled steam generation device will be capable of instantly adjusting to varying demands for steam volumes and temperatures as specified by human operator, said computer controlled steam generating device will be capable of producing said demanded steam volumes and temperatures without extinguishing said combustion, and said computer controlled steam generation device will store said fuel, air and water valve settings for later uses, when needed in response to said demands by a human operator.

* * * * *